US005429275A

United States Patent [19]

Katz

[11] Patent Number: 5,429,275

[45] Date of Patent: Jul. 4, 1995

[54] DISPENSER OF DOSES OF LIQUIDS AND PASTE-LIKE MASSES

[76] Inventor: Otto Katz, Michael-Kupfer-Strasse 3a, D-91126 Schwabach, Germany

[21] Appl. No.: 167,995

[22] PCT Filed: Jun. 29, 1992

[86] PCT No.: PCT/EP92/01461

§ 371 Date: Dec. 21, 1993

§ 102(e) Date: Dec. 21, 1993

[87] PCT Pub. No.: WO93/01100

PCT Pub. Date: Jan. 21, 1993

[30] Foreign Application Priority Data

Jul. 2, 1991 [DE] Germany ..... 41 21 834.5
Mar. 28, 1992 [DE] Germany ..... 42 10 225.1

[51] Int. Cl.[6] ..... B65D 37/00

[52] U.S. Cl. ..... 222/108; 222/321.8; 222/340; 222/380; 222/496

[58] Field of Search ..... 222/321, 340, 341, 380, 222/383, 387, 402.12, 256, 505, 509, 153, 496, 108

[56] References Cited

U.S. PATENT DOCUMENTS 3,154,224 10/1964 Wakeman ..... 222/402.12
4,793,522 12/1988 Corsette ..... 222/387 X
5,052,592 10/1991 Wilken et al. ..... 222/387
5,273,191 12/1993 Meshberg ..... 222/496 X
5,301,850 4/1994 Gueret ..... 222/321 X

FOREIGN PATENT DOCUMENTS 0230252 7/1987 European Pat. Off. .
0340724 11/1989 European Pat. Off. .
0367097 7/1990 European Pat. Off. .
0378286 7/1990 European Pat. Off. .
2524348 10/1983 France .
1653398 8/1971 Germany .

*Primary Examiner*—Kevin P. Shaver
*Attorney, Agent, or Firm*—Laff, Whitesel, Conte & Saret, Ltd.

[57] ABSTRACT

A dispenser for the metered discharge of liquids and in particular pasty masses, having a delivery pump actuatable by finger pressure. The pump has a vacuum-type action and a restoring spring and pressure and suction valves. The container to which the pump is to be attached preferably is a container having resilient walls. The pump has a discharge bore with a closure element, to open and close the discharge bore. The pump has a pump chamber that is open and closed at its top end by a pressure valve. The pressure valve is connected to a plunger. A suction valve is axially spaced from the pressure valve and the suction valve is positioned to open and close the bottom end of the pump chamber. Contact zones are provided between the suction valve and the pressure valve. The plunger is displaceable in the delivery direction, and a restoring spring is located outside of the pump chamber. The restoring spring is clamped between a shoulder surrounding the pump chamber and a plunger flange. A sliding guidance is connected with a metering head. The guidance has a circumferential edge that acts as a stop and there is a closure element movable in the discharge bore by a lever key connected thereto.

31 Claims, 4 Drawing Sheets

DISPENSER OF DOSES OF LIQUIDS AND PASTE-LIKE MASSES

Figure 1:
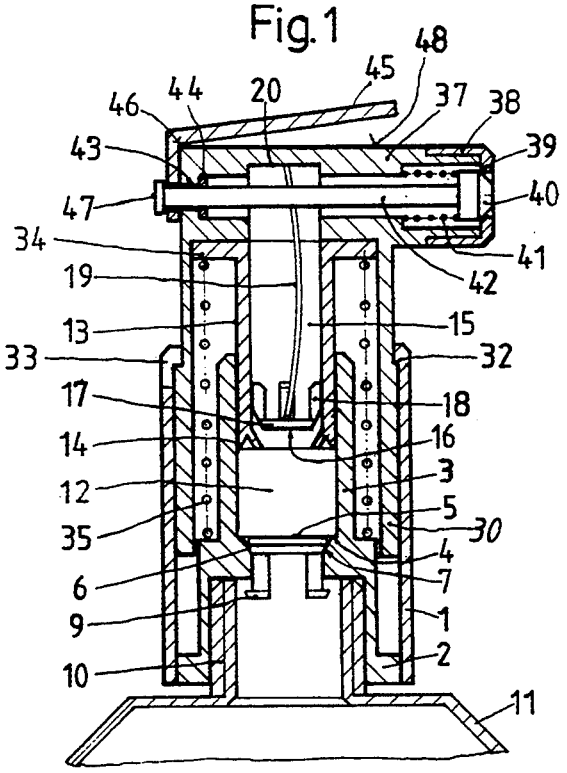

The invention relates to a liquid and paste dispenser and more particularly to a finger operated paste dispenser.

A paste dispenser of similar type is described for example in EP 0 230 252 A2. In this case suction and pressure valves are formed as hinged flaps, of which the opening and closing function can be affected by the hinging and adhesive forces. Furthermore there are no measures cited, in order to attain a tight closure of the discharge bore with gas emitting media.

It is an object of the invention to propose a paste dispenser of the generic type, which produces an intensive suction effect with simple means, in order to achieve a high filling degree of the pump room in connection with mechanical aids, which additionally support the valve function and in order to guarantee emptying of a storage container, which can be changed by underpressure.

It is furthermore an object to open a closure, coupled with the actuating key, of the discharge bore before the start of delivery and to close it after the end of delivery.

The advantages attainable by the invention consist in that a paste dispenser, which can be manufactured with simple means, can be manually operated by finger pressure, and that measures for attaining a high suction effect permit the combination for example with commercial tubes serving as storage containers, whereby the medium can be protected against drying-in and gas losses by a controllable closure, and that environmental pollution is fought by reusing the metering head.

In a further embodiment of the invention it is advantageous for attaining a high suction effect to have the dead space in the lowest plunger position tend toward zero, if possible, and on this occasion to produce a contact zone between the pressure valve and the suction valve, in order to open the suction valve as soon as the suction lift starts not only by underpressure, but also by adhesive forces, which are created in the contact zone by cooperation of the pasty mass. In like manner the pressure valve meets an additional sealing force with the start of the suction lift. Within the opening lift of the suction valve, which is defined by stop edges on guide segments, the suction valve is longitudinally moved together with the plunger, so that the underpressure produced by the plunger is available in its full strength for taking in the paste and not only for elevating the suction valve.

A further embodiment of the invention shows that the contact zone for driving the suction valve with the start of the suction lift is effected by means of a plug cone, which adjoins the valve seat of the pressure valve and to which a corresponding bore in the suction valve is associated. The suction valve is opened by the positive locking of the plug cone connected with the suction valve, as soon as the suction lift of the plunger starts. Simultaneously, the closing pressure of the pressure valve is increased to the same extend.

A further embodiment of the contact zone between the pressure and the suction valve shows a friction bar fixedly connected with the pressure valve, which penetrates a bore of the suction valve, the fit being such that closeness as well as friction are produced. In this connection, the opening and closing movements of the suction and pressure valve are supported during both the suction and the delivery lift.

A further embodiment of the pressure valve consists in that for attaining an untilted longitudinal guide, guide webs are molded on the conical pressure valve seat, and that with an embodiment in a plastic material a spring bar is molded on, the lateral swinging-out movement of which produces the spring potential, which supports the closeness of the pressure valve during the suction lift.

Figure 3:
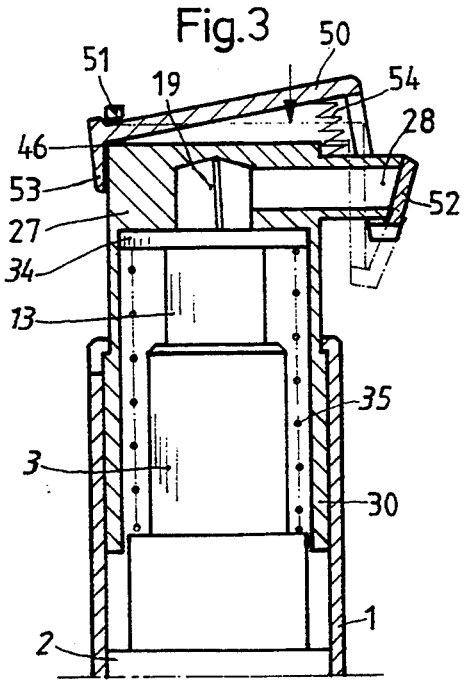

As far as the subject matter of the invention is provided for media, which require a special closure of the discharge bore because of drying-in or gas emissions, then a lever key is provided for this purpose, which in simple manner has a double function, and which on the one hand brings the closure element into its open position when being actuated, and on the other hand, when a stop on the metering head is reached, effects the latter's actuation. It is advantageous with this arrangement that only after the closure element is opened, the delivery of the paste starts and thus piling up of the delivery medium and enhancement of the operating forces are avoided. FIG. 3 shows a simpler embodiment of the closure element communicating with the lever key. On this occasion a cover lock with plane surfaces is molded on the lever key, the cover lock being tangentially movable in relation to the front surface of the discharge bore. Advantageously this embodiment is especially simple in manufacture and assembly.

A further advantageous form of embodiment is disclosed in claim 18. The advantages, which can be attained in this embodiment, consist in particular in that a dispenser, which can be manufactured with simple means, can be manually operated by finger pressure, and that measures for attaining a high suction effect permit the combination for example with commercial tubes serving as storage containers, whereby the material can be protected without an additional cap against drying-in, microbian attack and storage losses by an automatically controllable closure, and that environmental pollution is reduced by reusing the dispenser, which can be separated from the storage container.

The advantages, which can be attained by the invention, consist especially in that the delivery plunger is movable in a cylinder, which is free of components, as e.g. a compression spring, and which is free of non-usable spaces, which are produced for example in the embodiment of suction and pressure valve zones.

This permits a function of the delivery plunger without or only with a minimum dead space. This means that during an effected suction lift a maximum underpressure can be achieved, by means of which cream-like or even viscous materials become capable of being sucked and thus capable of being pumped.

A further support of the suction behaviour is considered in that with the movement start of the suction lift, the suction valve is opened mechanically and without delay not only by underpressure, but also by a releasable connection with the delivery plunger. By means of this adhesive and binding forces on the suction valve seat are surmounted, and charging of the cylinder chamber and thus a safe function are ensured.

It is expedient that the valve cone, located in the delivery plunger, when bearing on the valve seat, forms a reception with the delivery plunger, which reception can be filled by an appendage of the suction valve. Consequently, side rooms which cannot be used for the suction process are avoided.

It seems to be advantageous that the releasable connection between the delivery plunger and the suction valve are formed by the reception and by an appendage, which preferably are directed towards each other conically tapering. By the conical embodiment of the releasable connection a positive locking between the suction valve and the delivery plunger is produced in simple manner, which causes a definable driving force.

It is expedient that the releasable connection between the delivery plunger and the suction valve can bear a lower axial force than the retaining force of the lift stops on the segments of the suction valve. It can be achieved by this that the snap engagement of the suction valve with the resilient lift stops cannot be released.

It is also advantageous for ensuring the function that the releasable connection between the delivery plunger and the suction valve bears a lower axial force than the biasing force, associated with this position of the delivery plunger, of the restoring spring. This ensures that the delivery plunger or the metering head, respectively, can always move back into its starting position.

A preferred embodiment of the delivery plunger and its attachment is given by the fact that the restoring spring takes its bearing on the one side on a flange connected with the delivery plunger and on the other side on the housing. By means of this it is achieved that the delivery plunger together with its components can be manufactured as a preassembly group and for assembly it is merely to be placed into the metering head, as its attachment is performed via the restoring spring.

The embodiment of the delivery plunger as a preassembly group consists in that a bush is fixedly connected with the delivery plunger and on the one hand serves for supporting the compression spring and on the other hand takes its bearing in the bore.

An advantageous embodiment of the metering head is considered in the fact that a metering head comprises an axis located transversely to the axis of the delivery plunger, which former axis has in common a control plunger, a tappet and a valve cone. By means of this a space-saving, handling-oriented arrangement of the mouthpiece valve is achieved with simple means.

It is expedient that the control plunger, the tappet and the valve cone can be manufactured in one piece and in a flexible material, and that also the biasing spring can be molded on the control plunger.

For the purpose of sealing the mouthpiece valve it is provided that in the non-actuated position the prestressing force of the biasing spring clamped between the control plunger and a cover has the valve cone bear on a valve seat. This arrangement proves to be especially handling-oriented, as the mouthpiece valve is automatically opened when producing the delivery pressure. It is advantageous for the application that no foreign materials can enter into the region within the mouthpiece valve, as a valve opening is equivalent to a metering quantity discharging under pressure.

Another embodiment of the control plunger consists in that the latter is formed as a pressure sealed, flexible disk, which can be swung out like a membrane about its clamping point. This results in a low-friction, i.e. easy responsive and reliably sealing arrangement. The disk can also be manufactured in one piece with the tappet and the valve seat.

A further advantageous embodiment of the control plunger is that the latter can be designed as flexible, pressure sealed bellows, by the shaping of which the valve cone resiliently takes its bearing on the valve seat.

A special embodiment of the external side of the mouthpiece is effected in that the mouthpiece valve comprises a front surface, which passes over into a half shell or into a trough.

Figure 2:
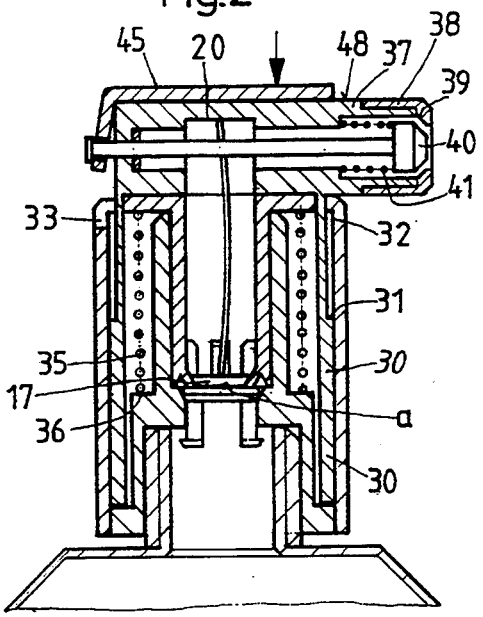
Figure 4:
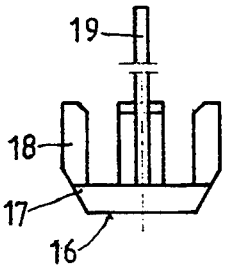
Figure 5:
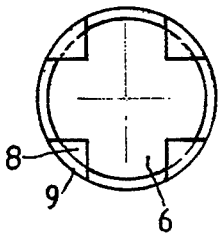
Figure 6:
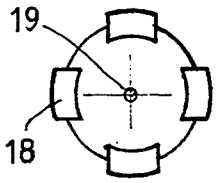
Figure 7:
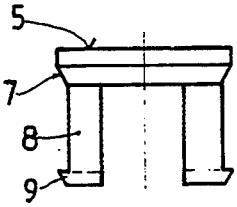
Figure 8:
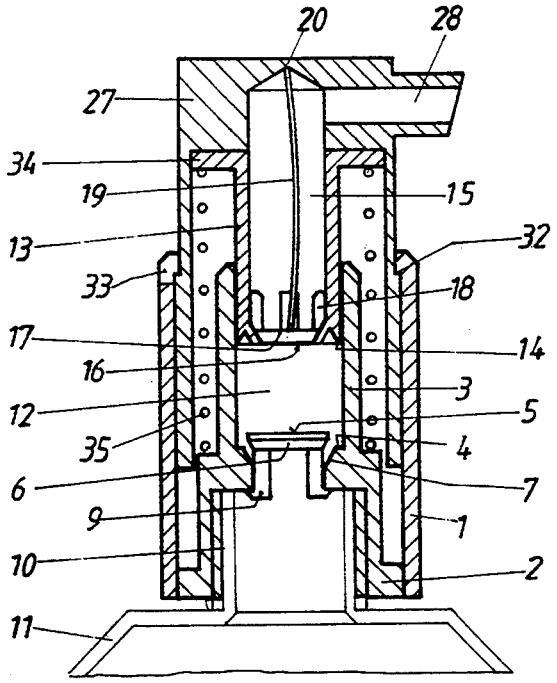
Figure 9:
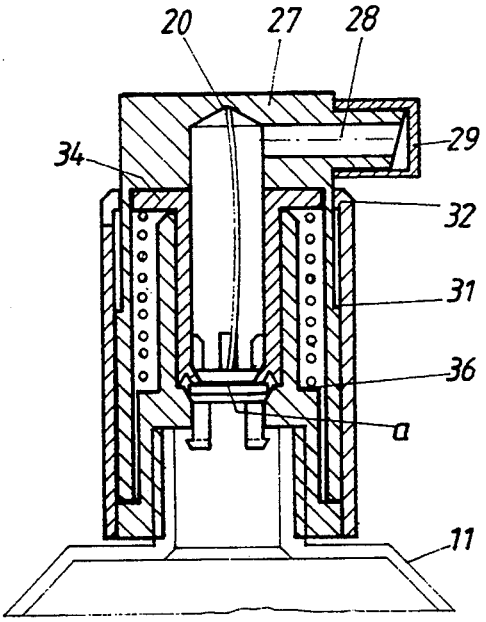
Figure 10:
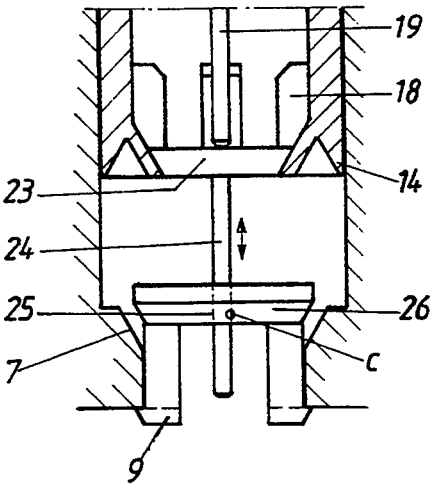
Figure 11:
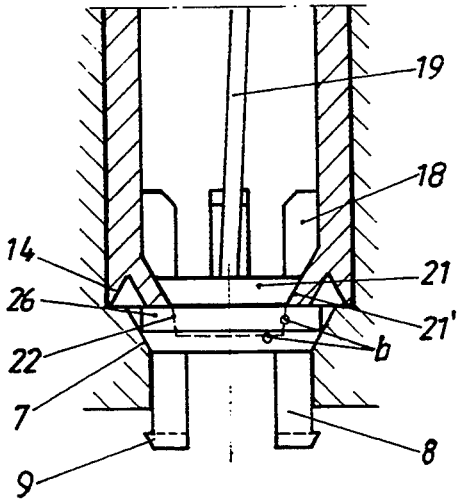
Figure 12:
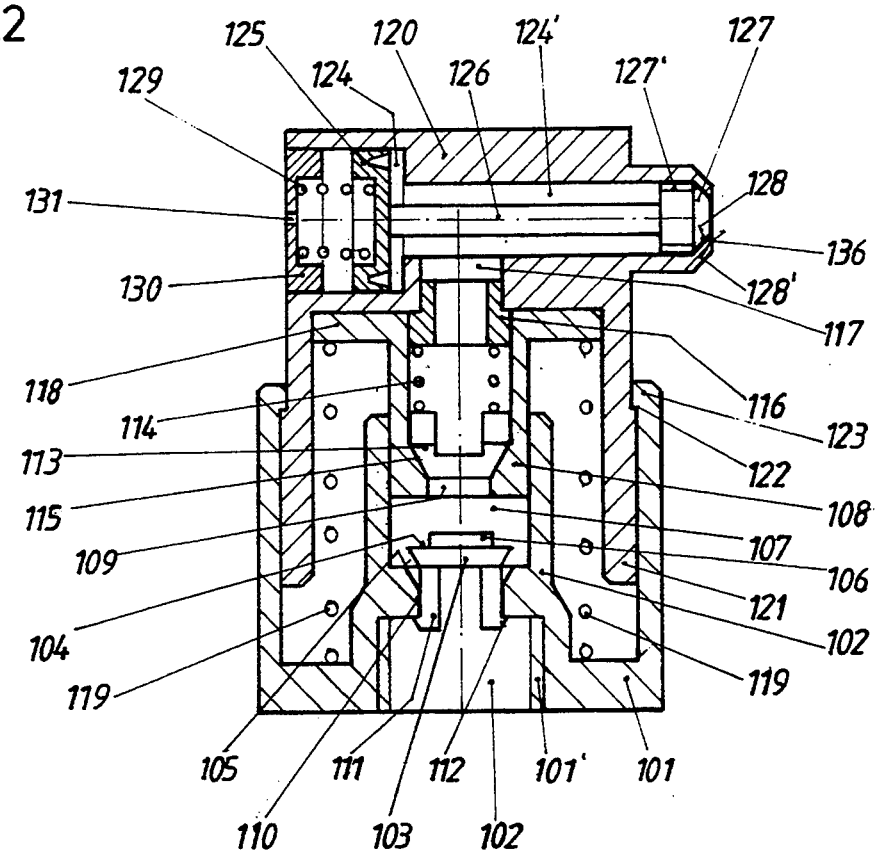
Figure 13:
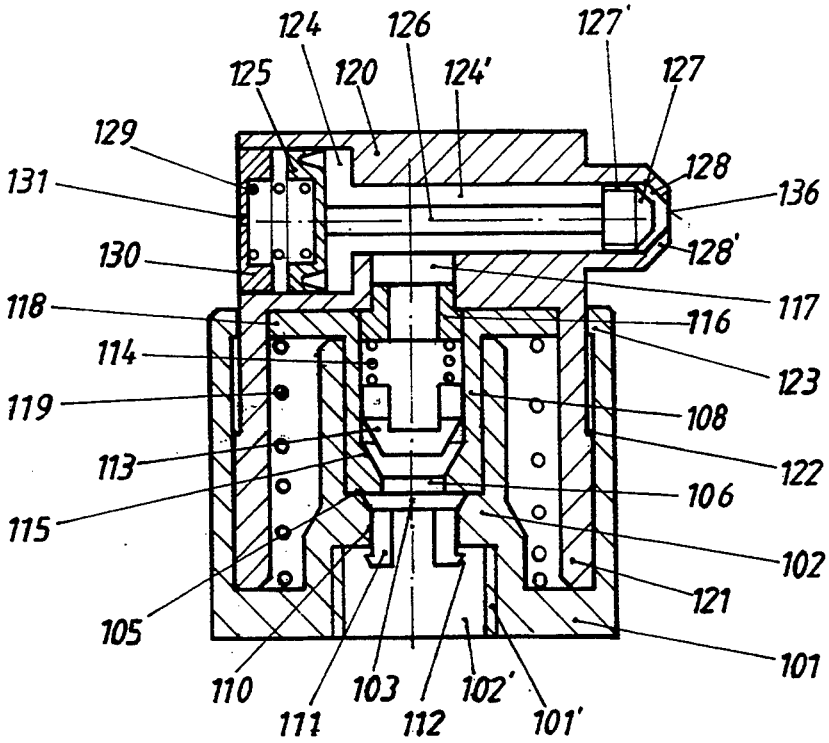
Figure 14:
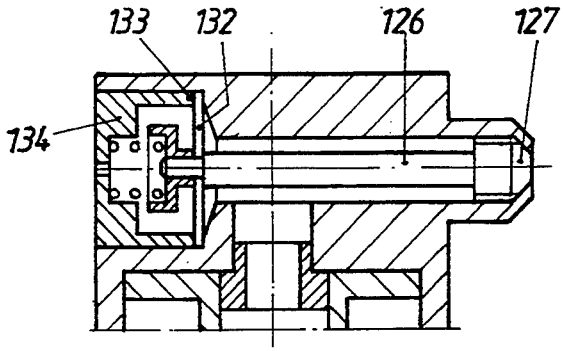
Figure 15:
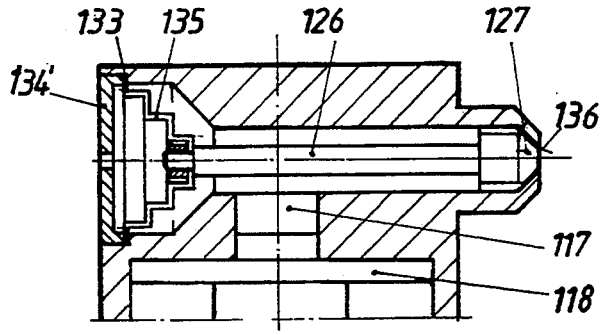
Figure 16:
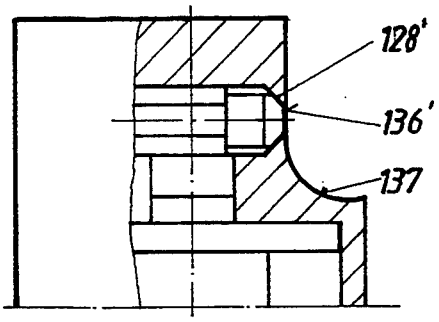
Figure 17:
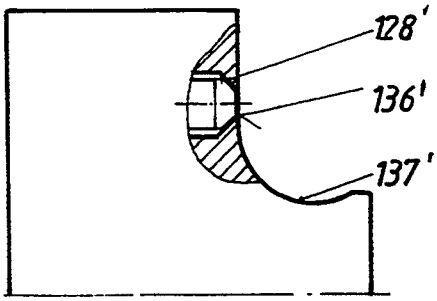

Examples of embodiment are described taken in conjunction with the drawing, in which FIG. 1 shows a side view with a closure, non-actuated, FIG. 2 shows a side view with a closure, actuated, FIG. 3 shows a side view of a lever key, FIG. 4 shows a pressure valve in side view, FIG. 5 shows an suction valve in plan view, FIG. 6 shows a pressure valve in plan view, FIG. 7 shows an suction valve in side view, FIG. 8 shows a side view, without a closure, non-actuated, FIG. 9 shows a side view, without a closure, actuated, FIG. 10 shows a pressure valve with a friction bar, FIG. 11 shows a pressure valve with a plug cone, FIG. 12 shows a longitudinal section, non-actuated, of a further embodiment, FIG. 13 shows a longitudinal section, actuated, FIG. 14 shows a partial longitudinal section, FIG. 15 shows a partial longitudinal section, FIG. 16, shows a detail, stripper surface, FIG. 17 shows a detail, stripper surface.

A guide housing 1 (FIGS. 1, 2) is rigidly connected with a delivery cylinder 3 via a flange 2. Both parts can also be manufactured in one piece. At the lower end of the delivery cylinder 3 a front wall 4 is located, which is flush with a plane surface 5 of an suction valve 6, on the conical valve seat 7 of which guide segments 8 are adjoined, which are provided with stop edges 9 for a lift stop. A thread 10 represents the communication with a storage container 11, which is preferably formed as a flexible tube.

In a delivery cylinder 3 a pump chamber 12 is located, on the inner wall of which a plunger 13 with its sealing 14 is slidable. The front sides of the plunger 13, consisting of sealing 14, plane surface 16 of the closed pressure valve 17 (FIG. 2), form a plane. On the pressure valve 17 guide webs 18 and a spring bar 19 are molded on, which can be laterally swung out and which takes its bearing on a supporting surface 20 of the metering head 21 and which keeps the pressure valve in a closed position.

In the actuated position in FIG. 2, the plane surface 16 of the pressure valve 17 contacts the plane surface 5 of the suction valve 6. This contact surface between suction valve 26' and pressure valve 21 is illustrated in FIG. 11 as a contact zone b. On the conical seat 7 of the pressure valve 21 a plug cone 22 is adjoined, which has a small cone angle in the direction of the valve axis, in order to achieve a releasable clinging in a corresponding recess of the suction valve 26'.

FIG. 10 shows the contact zone c between the bore 25 of the suction valve 26 and a friction bar 24, which is fixedly connected with a pressure valve 23. The contact zone c produces a sealing and friction-generating sliding connection between the pressure valve 23 and the suction valve 26, by means of which a mechanical control of the pressure and suction valves 23, 26 is attainable in dependance on the movement of the plunger 13.

According to FIGS. 8 and 9 the metering head 27 comprises in its simple form of embodiment a discharge bore 28, which can be closed by a cap 29. On the metering head 27 a cylindrical sliding guidance 30 is molded on, which is supposed to prevent tilting during actuation by its length. The circumferential edge 31 with the stop 32 forms the upper lift stop. On the guide housing 1 axial slits 33 are provided for radial expansion for the purpose of assembling the sliding guidance 30.

On its upper end the plunger 13 comprises a flange 34, which sealingly abuts on a corresponding plane surface of the metering head 27, due to the restoring spring 35, which is clamped between the shoulder 36 and the flange 34.

In a further improvement the metering head 37 contains a mouthpiece 38 according to FIGS. 1 and 2, on the valve seat 39 of which a closure element 40 abuts while being actuated by a compression spring 41. The closure element 40 is formed as a valve cone and is connected with a shaft 42, which is extended through the bore 43 out of the metering head 37, whereby a sealing ring 44 takes its bearing. The lever key 45 is pivotably supported in a fulcrum 46 and takes its bearing on a collar 47, as soon as the lever key 45 is loaded. The collar 47 can be designed as a retaining ring.

The actuation-force component produced by finger pressure on the lever key 45, which component lies in the axis of the plunger 13 and is necessary for moving the closure element 40, is smaller than the force, which is to be applied for moving the plunger 13, which force can be determined by the length of the lever, prestressing of the compression spring 41 and the restoring spring 35.

In FIG. 3 a lever key 50 is shown, which snap-engages on cams 51 and which is connected with a closure element 52, which is pivotable about the fulcrum 46. The closure element 52 is formed as a cover lock. The nose 53 connected with the lever key 50 abuts on the metering head 27 while being actuated by the compression spring and produces a sealing force on the closure element 52.

Functional description according to FIGS. 8, 9, 10, 11.

On the tube 11 filled with a paste the paste dispenser consisting of the remaining parts is screwed onto the thread 10. At first the air between the suction valve 5 and the tube 11 is to be removed by repeated finger pressure on the metering head 27. The effective performance of this measure is decisive for the further function and characterizes the advantageous embodiment of the invention. The very small dead space resulting with a pressed-down position of the metering head 27 in the contact zone a in FIG. 9, results in an effective underpressure, when the plunger 13 is returned into the non-actuated position, which underpressure is generated by the sealing 14 and by the pressure valve 17, which abuts in a sealing and resilient manner. The opening of the suction valve 6 immediately effected with the beginning of the suction lift while being cooperated by the adhesion in the contact zone a, leads to suction of the air in the region of the thread 10. When the delivery lift is repeated, the suction valve closes in known manner and the pressure valve 17, resiliently abutting by the spring bar 19, opens.

According to FIG. 11 for the purpose of opening the suction valve use is made of a positive locking in lieu of the adhesive force. The plug cone 22 as a continuation of the valve seat 21' of the pressure valve 21 is mounted in a corresponding recess in the suction valve 26'. With the suction movement of the plunger 13 the suction valve 26' is driven as far as to its stop edge 9. Then the positive locking in the contact zone b is released.

In FIG. 10 in the contact zone c an additional sealing force is applied by frictional locking at the bore 25 of the suction valve 26, as long as the pressure valve 23 with the plunger is in the delivery lift. Simultaneously, the friction in the contact zone c acts as an additional opening force onto the pressure valve 23, the opening path of which is limited by the spring bar 19 abutting on the supporting surface 20. In this case the spring bar 19 is slightly shortened, it acts only as a stop limit without spring action.

In the suction lift the frictional forces produced in the contact zone c act in the reversed direction. The suction valve 26 is additionally elevated, while the pressure valve 23 is additionally pressed into the closing position. It is advantageous that the aforesaid influence onto the control movement of pressure and suction valve can be effected in any desirable lift position or lift reversal.

FIGS. 1 and 2 show an embodiment, which provides a closure on the mouthpiece 38 for media, which are particularly liable to dry in or to emit gas. When actuating the lever key 45, the closure element 40 is elevated from its valve seat 39 by surmounting the prestressing force of the compression spring 41, by the lever key 45 tractively moving the shaft 42 by abutting on the collar 47. When the lever key 45 contacts the stopper 48, the closing element 40 reaches its maximum open position. In case of further increasement of the actuating force on the lever key 45 the metering head 37 with its sliding guidance 30 is moved downward in the guide housing 1. It is advantageous with this embodiment that only after a maximal opening of the mouthpiece 38 the delivery lift of the plunger 13 can be triggered, by means of which an easy-running actuation is achieved.

The extra long sliding guidance 30 together with the guide of the plunger 13 in the delivery cylinder 3 prevents tilting. In addition to the arrangement of the valves the restoring spring 35 located outside of the pump chamber 12 contributes to the fact that the dead space in the stop position of the plunger 13 can be kept very small.

The restoring spring 35 causes a sealing abutment of the flange 34, connected with the plunger 13, on the metering head 37. The opening position of the pressure valve 17 shown in FIG. 1 takes place in the delivery phase, the spring bar 19 molded on the pressure valve 17 swinging out. The spring bar 19 is guided around the shaft 42 in the region of the latter and eccentrically bears on the supporting surface 20.

In the example of embodiment according to FIGS. 12 and 13, which is also applicable for liquids, a housing 101 is connected in one piece with a cylinder 200. A thread 101' represents the releasable connection with a storage chamber 102', the storage container of which is not particularly shown. An suction valve 103 in its closed stage (FIG. 13) with its plate surface 104 is flush with a cylinder bottom 105, while a conical appendage 106 adjoining the plate surface 104 projects into a cylinder chamber 107 and releasably clings in a conical reception 109 in the lower stop position of a delivery plunger 108 (FIG. 13). The suction valve 103 is guided in a bore 110 by means of segments 111 and is fixed by lift stops 112 in its open position. In this position of the delivery plunger 108 the cylinder chamber 107 comprises a volume of about zero. In the delivery plunger 108 a longitudinally movable valve cone 113 is located, which sealingly takes its bearing on a valve seat 115 by a compression spring 114 (FIG. 12).

On its other side the compression spring 114 supports on a bush 116, which is fixedly connected with the delivery plunger 108 and which is sealingly mounted in a bore 117. The bore 117 produces the connection with a bore 124'. A flange 118 is molded onto the delivery plunger 108 and serves for supporting a restoring spring 119, which is counter-supported in the housing 1. The restoring spring 119 simultaneously serves as a longitudinal fixing of the delivery plunger 108 in the metering head 120. The latter is connected with a guide cylinder 121, the stop 122 of which takes its bearing on knobs 123 in the non-actuated position. The knobs 123 are engraved into the front side of the housing 101 after assembly. In the metering head 120 a bore 124 is located for receiving and sealing a slidable control plunger 125, which is connected with a tappet 126 and on the end of which a valve cone 127 is located, which comprises longitudinally oriented supply channels 127'.

By means of a biasing spring 129 the valve cone 127 takes its bearing on a valve seat 128, the surfaces of which are directed inwardly towards the bore 124'. The valve cone 127 and the valve seat 128 form a mouthpiece valve 128'.

The biasing spring 129 is supported on the one side on the control plunger 125 and on the other side on a cover 130, which is fixedly connected with the metering head 120 and which comprises an air bore 131. In FIG. 14 the control plunger is replaced by a flexible disk 132, which is sealingly fixed at a clamping point 133 and which can be swung about the latter towards both sides. In FIG. 15 the control plunger is replaced by flexible bellows 135, by the shaping of which an axial spring biasing can be attained, which has the valve cone 128 bear on the valve seat 128. By this manner the biasing spring 129 can be saved.

FIG. 15 shows a special embodiment of the stripper surface 136 of the mouthpiece valve 128'. In this case the stripper surface 136 is flush with a front surface 136', which represents a cylinder section through the metering head 120 and which passes over into a half shell 137. In FIG. 17 the half shell 137 is replaced by a trough 137'. Both arrangements prevent draining or dropping off of excess cream.

When actuating the metering head 120 for the first time, the latter is moved from the starting position (FIG. 12) into the lower stop position (FIG. 13). During this process the pressure valve 113 is opened by the compression pressure produced in the cylinder chamber 107, and the suction valve 103 is closed. As soon as the delivery plunger 108 approaches the cylinder bottom 105, the appendage 106 of the suction valve 103 engages with the reception 109 of the delivery plunger 108 and produces a releasable connection at this place. At the lower dead point the delivery plunger 108 forms a cylinder chamber 107, which corresponds to an approximate zero volume. When the metering head 120 is returned into the starting position (FIG. 12), the suction valve 103 is mechanically driven with the delivery plunger 108, until the lift stops 112 of the suction valve 103 rest on the housing 101. The opening of the suction valve 103 is also supported by the underpressure produced.

When again exerting the pressure lift onto the metering head 120, the valve cone 113 opens with a simultaneous closure of the suction valve 103, and a delivery pressure is produced in the bore 124 and 124'. This pressure also actuates upon the control plunger 125, the effective work surface of which is diminished by the surfaces, projected normal to the longitudinal axis, of the valve cone 127. As soon as the force of pressure, acting onto the control plunger 125, of the delivery medium exceeds the prestressing force of the biasing spring 129, the control plunger 125 moves opposite the operation of the biasing spring 129. On this occasion the valve cone 127 is elevated from the valve seat 128 and discharges outwards a partial amount of paste.

Air locks in the storage chamber 102' are sucked off by the aforesaid suction conditions, without the function being permanently interrupted.

I claim:

1. A finger actuatable dispenser for the metered discharge of liquids and pasty masses from a container comprising:

connecting means to connect said dispenser to said container, a dispenser housing, a delivery pump connected to said housing and axially movable within said housing, said delivery pump having a discharge bore, a pump chamber (12), a pressure valve (17) to open and close one end said pump chamber, a plunger (13), a seal (14) connected to one end of said plunger, a suction valve (6) connected to the other end of said pump chamber to open and close another end of said pump chamber, said suction valve (6) and pressure valve (17) being axially spaced from each other, said suction valve having means for limiting axial movement within said pressure chamber, open and close means (40, 52) in said dispenser to open and close said discharge bore, a restoring spring (35) connected to said plunger and supported on a shoulder within said dispenser to urge said plunger to a non-delivery position, said delivery pump having a stop (31) on its outer surface to cooperate with a dispenser housing stop (32) to limit the relative axial movement of said delivery pump and said plunger, said pressure valve contacting said suction valve to reduce said pump chamber to a minimum volume, said pressure valve cooperating with said seal to close said pump chamber one end when the plunger is moved to increase the volume of said pump chamber.

2. A dispenser according to claim 1 wherein a contact zone (a) is formed in a lower plunger position by plane surfaces (5, 16) of the pressure valve and the suction valve to produce adhesive forces with the aid of a delivery medium.

3. A dispenser according to claim 2 wherein the suction valve (6) is longitudinally movable with the plunger (13) in a suction direction by an under pressure and by adhesive forces.

4. A dispenser according to claim 1 wherein the pressure valve (21) has a valve seat (21') connected to the plunger and a plug cone (22), and said,plug cone corresponds a corresponding conical bore in the suction valve (26').

5. A dispenser according to claim 1 wherein a friction bar (24) is fixedly connected to the pressure valve (23), said friction bar extends toward said suction valve and penetrates a bore (25) in the suction valve (26) and has a contact zone (c) with said suction valve.

6. A dispenser according to claim 5 wherein the friction bar is positioned and sized to provide with the downward movement of the plunger (13) additional opening forces on the contact zone (c) on the suction valve (26), and additional closing forces on the pressure valve (23).

7. A dispenser according to claim 5 wherein the friction bar is positioned and sized to provide with the upward movement of the plunger (13) additional opening forces on the contact zone (c) on the suction valve (26), and additional closing forces on the pressure valve (26).

8. A dispenser according to claim 1 wherein the suction valve (6, 26, 26') has a valve plate with a conical valve seat (7), and guide segments (8) having said means for limiting which comprises stop edges (9), said guide segments and stop edges being molded on said conical valve seat.

9. A dispenser according to claim 1 wherein the pressure valve (17, 21, 23) has a valve plate with the conical valve seat (7), on which guide webs (18) and a spring bar (19) are molded.

10. A dispenser according to claim 1 wherein a lever key (45) is connected to said open and close means, said lever key is pivotable about a fulcrum (46) to a metering head (37) which forms the discharge bore.

11. A dispenser according to claim 10 wherein the actuating force, to move the lever key (45) on the metering head (37), is smaller than the force which is required for the movement of the metering head (37).

12. A dispenser according to claim 10 wherein the open and close means has a shaft (42) that passes through said metering head and is connected to said lever key, said shaft being sealable against a metering head bore (43) by means of an O-ring (44).

13. A dispenser according to claim 12, wherein the shaft (42) has a collar (47) formed as a retaining ring to connect said lever key to said shaft.

14. A dispenser according to claim 1 wherein a lever key (50) is connected with said open and close means (52), said open and close means is formed as a cover lock and is movable tangentially to a from surface of the discharge bore (28).

15. A dispenser according to claim 14 wherein a nose (53) is connected to the lever key (50) and is supported on a metering head (27) in a non-actuated position, and wherein sealing pressure of the open and close means on front surfaces of the discharge bore (28) is intensified.

16. A dispenser according to claim 1 wherein the plunger (13) has a molded-on flange (34) and is manufactured of a flexible plastic material.

17. A dispenser according to claim 1 wherein in the non-actuated position, the depth of a guide on the delivery pump in the dispenser housing (1) is greater than the depth of penetration of the plunger (13) into a delivery cylinder (3) which defines said pump chamber.

18. A dispenser according to claim 1, wherein the pump chamber defines a cylinder, the volume of which is zero when the plunger is on the cylinder bottom, and in that in this position there is a releasable connection between the plunger and the suction valve, the open and close means comprising a valve cone which bears against a valve seat (128) of the discharge bore, and a control means (125) connected to said valve cone for controlling its movement, said control means includes a biasing means (129) and being reciprocally longitudinally movable by delivery pressure from the pump and by said biasing means (129).

19. A dispenser according to claim 18, wherein said plunger is slidable within said cylinder, the plunger has a bottom plunger valve seat (115) to receive said pressure valve which is axially movable within the plunger (108), said valve seat forming a reception (109) which can be fried by an appendage (106) extending from the suction valve (103).

20. A dispenser according to claim 18, wherein the releasable connection between the plunger (108) and the suction valve (103) is formed by a reception groove in a plunger valve seat and an appendage (106) extending from the suction valve.

21. A dispenser according to claim 20, wherein the suction valve has a guide (111) having said means for limiting thereon to limit the movement of the suction valve, the releasable connection between the plunger (108) and the suction valve (103) having a lower axial force than a retaining force of the means for limiting on the guide (111) of the suction valve (103).

22. A dispenser according to claim 20, wherein the releasable connection between the delivery plunger (108) and the suction valve (103) having a lower axial force than a biasing force, associated with the restoring spring (119).

23. A dispenser according to claim 18, wherein said restoring spring (119) bears on a flange (118) connected to the plunger (108) and bears on said shoulder.

24. A dispenser according to claim 18, wherein a bushing (116) is fixedly connected to the plunger (108) and supports a pressure spring (114) and is positioned in a plunger bore (117).

25. A dispenser according to claim 18, wherein the discharge bore is formed by a metering head (120) which comprises an axis located transversely to the axis of the plunger (108), said metering head having said control means (125), said valve cone (127) and an interconnecting tappet (126) disposed therein.

26. A dispenser according to claim 25, wherein the control means (125), the tappet (126) and the valve cone (127) are one-piece and are made from a flexible material.

27. A dispenser according to claim 26, wherein the control means has said biasing means molded thereon.

28. A dispenser according to claim 18, wherein in the non-actuated position the force of said biasing means (129) is clamped between the control means (125) and a cover (130) and the valve cone (127) bears on the valve seat (128).

29. A dispenser according to claim 18, wherein the control means is a pressure scaled, flexible disk (132), which can be swung out about a point at which it is clamped to the dispenser.

30. A dispenser according to claim 18, wherein biasing means of the control means is a flexible pressure sealed bellows (135), said sealed bellows urges the valve cone (127) resiliently on the valve seat (128).

31. A dispenser according to claim 18, wherein the valve cone is a mouth-piece valve (128') having a from surface (136), disposed over a half shell (137) or a trough (137') of a metering head of the dispenser of a metering head of the dispenser.

* * * * *

UNITED STATES PATENT AND TRADEMARK OFFICE

CERTIFICATE OF CORRECTION

PATENT NO. : 5,429,275

DATED : July 4, 1995

INVENTOR(S) : Otto Katz

It is certified that error appears in the above-indentified patent and that said Letters Patent is hereby corrected as shown below:

Column 8, line 57, after "said" delete ",".

Column 9, line 39, delete "from" and insert --front--

Column 10, line 8, delete "fried" and insert --filled--.

Column 10, line 60, delete "from" and insert --front--.

Column 10, line 62, delete "of a metering head of the dispenser".

Signed and Sealed this

Tenth Day of October, 1995

Bruce Lehman

*Attest:*

BRUCE LEHMAN

*Attesting Officer*

*Commissioner of Patents and Trademarks*